US011798475B2

(12) United States Patent
Choi et al.

(10) Patent No.: US 11,798,475 B2
(45) Date of Patent: Oct. 24, 2023

(54) ELECTRONIC DEVICE

(71) Applicant: Samsung Display Co., Ltd., Yongin-si (KR)

(72) Inventors: Yang-Hwa Choi, Hwaseong-si (KR); Hyuk Kim, Suwon-si (KR); Junghwan Hwang, Seongnam-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 17/707,906

(22) Filed: Mar. 29, 2022

(65) Prior Publication Data

US 2022/0351680 A1 Nov. 3, 2022

(30) Foreign Application Priority Data

May 3, 2021 (KR) ..... 10-2021-0057357

(51) Int. Cl.

| | |
|---|---|
| ***G09G 3/3233*** | (2016.01) |
| *G09G 3/3266* | (2016.01) |
| *G09G 3/3283* | (2016.01) |

(52) U.S. Cl.

CPC ..... *G09G 3/3233* (2013.01); *G09G 3/3266* (2013.01); *G09G 3/3283* (2013.01); *G09G 2300/0426* (2013.01); *G09G 2300/0842* (2013.01); *G09G 2320/0233* (2013.01); *G09G 2320/043* (2013.01)

(58) Field of Classification Search

CPC .. G09G 3/3233; G09G 3/3266; G09G 3/3283; G09G 2300/0426; G09G 2300/0842; G09G 2320/0233; G09G 2320/043

See application file for complete search history.

(56) References Cited

U.S. PATENT DOCUMENTS

| | | | |
|---|---|---|---|
| 9,514,686 | B2 | 12/2016 | Lee et al. |
| 9,874,891 | B2 | 1/2018 | Imes et al. |

(Continued)

FOREIGN PATENT DOCUMENTS

| | | |
|---|---|---|
| KR | 10-2017-0081046 | 7/2017 |
| KR | 10-2018-0127896 | 11/2018 |

(Continued)

*Primary Examiner* — Jeff Piziali

(74) *Attorney, Agent, or Firm* — H.C. Park & Associates, PLC

(57) ABSTRACT

An electronic device includes a pixel driving circuit to operate in a light emitting mode or a sensing mode and including a reference voltage line for receiving a reference voltage comprising a first reference voltage and a second reference voltage different from the first reference voltage and a light emitting diode including a first electrode, a light emitting element, and a second electrode. The light emitting diode has in an on-state or an off-state in the light emitting mode, the first reference voltage is applied to the reference voltage line in the light emitting mode, a first voltage is applied to the first electrode in the off-state, a second voltage is applied to the first electrode in the on-state, the sensing mode includes an initialization period and a sensing period, and the second reference voltage is applied to the reference voltage line in the initialization period.

12 Claims, 10 Drawing Sheets

(56) References Cited

U.S. PATENT DOCUMENTS

| | | | | |
|---|---|---|---|---|
| 2004/0066358 | A1* | 4/2004 | Numao | G09G 3/3291 345/76 |
| 2015/0130785 | A1* | 5/2015 | Shin | G09G 5/18 345/82 |
| 2016/0078813 | A1* | 3/2016 | Mizukoshi | G09G 3/3233 438/23 |
| 2017/0038898 | A1* | 2/2017 | Kim | G06F 3/0412 |
| 2020/0043421 | A1* | 2/2020 | Kang | G09G 3/3275 |
| 2020/0210010 | A1* | 7/2020 | Kim | G06F 3/0412 |
| 2021/0201718 | A1* | 7/2021 | Ha | G09G 3/32 |

FOREIGN PATENT DOCUMENTS

| | | |
|---|---|---|
| KR | 10-2019-0067672 | 6/2019 |
| KR | 10-2056784 | 1/2020 |

* cited by examiner

ELECTRONIC DEVICE

CROSS-REFERENCE TO RELATED APPLICATION

This application claims priority from and the benefit of Korean Patent Application No. 10-2021-0057357, filed on May 3, 2021, which is hereby incorporated by reference for all purposes as if fully set forth herein.

BACKGROUND

Field

Embodiments of the invention relate generally to an electronic device and more specifically, to an electronic device operating in a light emitting mode and a sensing mode.

Discussion of the Background

Various display devices that are applied to electronic devices, such as televisions, mobile phones, tablet computers, navigation units, and game units have been developed. Among the display devices, an organic light emitting display device displays images using an organic light emitting diode that generates a light by a recombination of electrons and holes. The organic light emitting display device has the advantages of fast response speed and low power consumption.

The organic light emitting diode is turned on or off by a driving transistor. The driving transistor has inherent characteristics, such as a threshold voltage, a mobility, and the like, and these characteristic values are different for each driving transistor. In addition, the driving transistor is deteriorated as a driving time elapses, and the inherent characteristics of the driving transistor are changed. Even though the driving time is the same, there is a difference in degree of deterioration between driving transistors, and the difference of the deterioration causes a deviation in the inherent characteristics between the driving transistors.

The deviation in the inherent characteristics between the driving transistors causes a luminance difference and a luminance non-uniformity of the organic light emitting display device.

The above information disclosed in this Background section is only for understanding of the background of the inventive concepts, and, therefore, it may contain information that does not constitute prior art.

SUMMARY

Electronic devices constructed according to the principles of the invention are capable of improving and enhancing display quality by providing accurate and precise measurements for sensing inherent characteristics of driving transistors of the electronic devices.

Additional features of the inventive concepts will be set forth in the description which follows, and in part will be apparent from the description, or may be learned by practice of the inventive concepts.

According to an aspect of the invention, an electronic device includes: a pixel driving circuit to operate in a light emitting mode or a sensing mode, the pixel driving circuit including a reference voltage line for receiving a reference voltage including a first reference voltage and a second reference voltage different from the first reference voltage and a light emitting diode including a first electrode, a light emitting element, and a second electrode.

The light emitting diode has an on-state or an off-state in the light emitting mode, the first reference voltage is applied to the reference voltage line in the light emitting mode, a first voltage is applied to the first electrode in the off-state of the light emitting diode, a second voltage is applied to the first electrode in the on-state of the light emitting diode, and wherein: the sensing mode includes an initialization period and a sensing period, and the second reference voltage is applied to the reference voltage line in the initialization period.

The second reference voltage may have a voltage level between the first voltage and the second voltage.

The reference voltage may have a floating state in the sensing period.

When viewed in plane, at least a portion of the first electrode may overlap the reference voltage line.

The second voltage may be higher than the first voltage.

The second reference voltage may have a voltage level obtained by dividing a sum of the first voltage and the second voltage by 2.

The pixel driving circuit may further include a driving transistor for driving the light emitting diode, a sensing transistor electrically connected between a first node of the driving transistor and the reference voltage line, and a switching transistor electrically connected between a second node of the driving transistor and a data line.

The sensing transistor and the switching transistor may be turned on in the initialization period.

The sensing transistor may be turned on in the sensing period, and the switching transistor may be turned off in the sensing period.

The first voltage may have a same voltage level as the first reference voltage.

The second reference voltage may be higher than the first reference voltage.

The second reference voltage may be higher than the first voltage and lower than the second voltage.

According to another aspect of the invention, an electronic device includes: a display panel including a plurality of pixels, the display panel to operate in a light emitting mode and a sensing mode. Each of the pixels includes a light emitting diode including a first electrode, a light emitting element, and a second electrode, a driving transistor for driving the light emitting diode, a sensing transistor electrically connected between a first node of the driving transistor and a reference voltage line, and a switching transistor electrically connected between a second node of the driving transistor and a data line. A first voltage or a second voltage different from the first voltage is applied to the first node in the light emitting mode, and a third voltage different from each of the first voltage and the second voltage is applied to the reference voltage line in the sensing mode.

The third voltage may have a voltage level between the first voltage and the second voltage.

When viewed in plane, at least a portion of the first electrode may overlap the reference voltage line.

The first voltage may be lower than the second voltage.

The third voltage may be an average value between the first voltage and the second voltage.

The light emitting diode may have an on-state or an off-state, the first voltage is applied to the first node in the off-state, and the second voltage may be applied to the first node in the on-state.

The sensing mode may include an initialization period and a sensing period, and the sensing transistor and the switching transistor may be turned on in the initialization period.

The sensing transistor may be turned on in the sensing period, and the switching transistor may be turned off in the sensing period.

According to another aspect of the invention, an electronic device includes: a plurality of pixels, each pixel to operate in a light on-state mode, a light off-state mode, and a sensing mode, each pixel including: a light emitting diode for emitting light; and a driving transistor for driving the light emitting diode, the driving transistor connected to the light emitting diode at a first node, wherein: the first node is charged with a first voltage in the light off-state mode, in which the light emitting diode emits light, the first node is charged with a second voltage higher than the first voltage in the light on-state mode, in which the light emitting diode does not emit light, and the first node is charged with a third voltage in the sensing mode, in which inherent characteristic of the driving transistor is measured, the third voltage being higher than the first voltage and lower than the second voltage.

The third voltage may have a voltage level between the first voltage and the second voltage.

According to the above, the second reference voltage is applied to the reference voltage line in the initialization period of the sensing mode, and thus, a difference between a parasitic capacitance formed after displaying a black image and a parasitic capacitance formed after displaying a red or white image is reduced. Accordingly, influences on a sensing operation by the parasitic capacitance in the sensing mode is reduced. Thus, a sensing accuracy is improved, and an accuracy of a signal control circuit in calculating a compensation value is improved. As a result, the display quality of the electronic device is improved.

It is to be understood that both the foregoing general description and the following detailed description are illustrative and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate illustrative embodiments of the invention, and together with the description serve to explain the inventive concepts.

DETAILED DESCRIPTION

Figure 1:
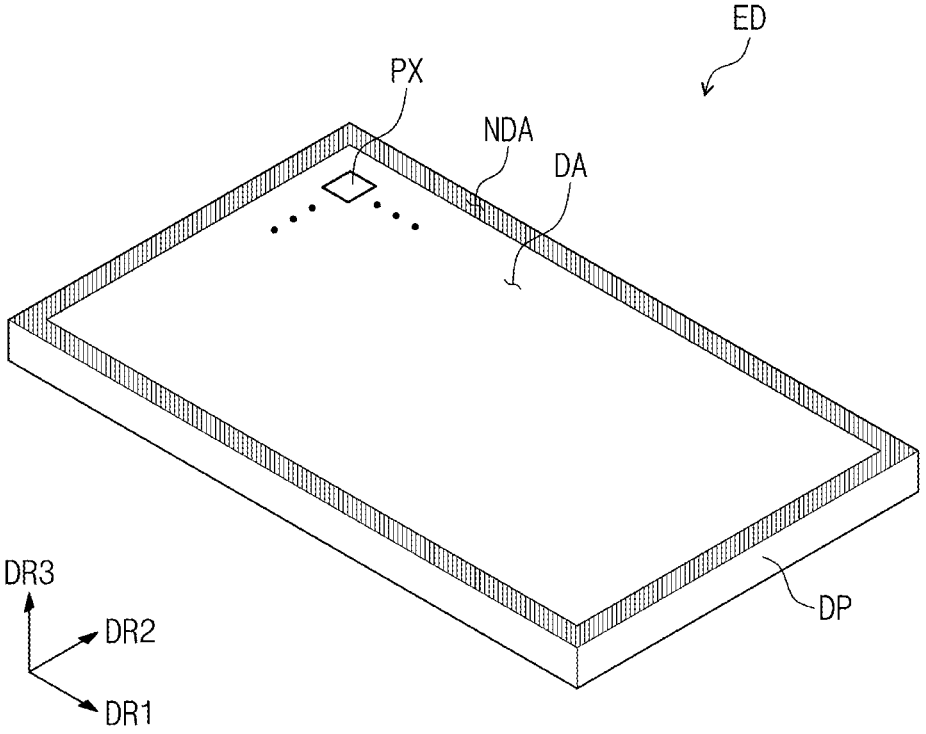
FIG. 1 is a perspective view of an embodiment of an electronic device constructed according to the principle of the invention.

In the following description, for the purposes of explanation, numerous specific details are set forth in order to provide a thorough understanding of various embodiments or implementations of the invention. As used herein "embodiments" and "implementations" are interchangeable words that are non-limiting examples of devices or methods employing one or more of the inventive concepts disclosed herein. It is apparent, however, that various embodiments may be practiced without these specific details or with one or more equivalent arrangements. In other instances, well-known structures and devices are shown in block diagram form in order to avoid unnecessarily obscuring various embodiments. Further, various embodiments may be different, but do not have to be exclusive. For example, specific shapes, configurations, and characteristics of an embodiment may be used or implemented in another embodiment without departing from the inventive concepts.

Unless otherwise specified, the illustrated embodiments are to be understood as providing illustrative features of varying detail of some ways in which the inventive concepts may be implemented in practice. Therefore, unless otherwise specified, the features, components, modules, layers, films, panels, regions, and/or aspects, etc. (hereinafter individually or collectively referred to as "elements"), of the various embodiments may be otherwise combined, separated, interchanged, and/or rearranged without departing from the inventive concepts.

The use of cross-hatching and/or shading in the accompanying drawings is generally provided to clarify boundaries between adjacent elements. As such, neither the presence nor the absence of cross-hatching or shading conveys or indicates any preference or requirement for particular materials, material properties, dimensions, proportions, commonalities between illustrated elements, and/or any other characteristic, attribute, property, etc., of the elements, unless specified. Further, in the accompanying drawings, the size and relative sizes of elements may be exaggerated for clarity and/or descriptive purposes. When an embodiment may be implemented differently, a specific process order may be performed differently from the described order. For example, two consecutively described processes may be performed substantially at the same time or performed in an order opposite to the described order. Also, like reference numerals denote like elements.

When an element, such as a layer, is referred to as being "on," "connected to," or "coupled to" another element or layer, it may be directly on, connected to, or coupled to the other element or layer or intervening elements or layers may be present. When, however, an element or layer is referred to as being "directly on," "directly connected to," or "directly coupled to" another element or layer, there are no intervening elements or layers present. To this end, the term "connected" may refer to physical, electrical, and/or fluid connection, with or without intervening elements. Further, the DR1-axis, the DR2-axis, and the DR3-axis are not limited to three axes of a rectangular coordinate system, such as the x, y, and z-axes, and may be interpreted in a broader sense. For example, the DR1-axis, the DR2-axis, and the DR3-axis may be perpendicular to one another, or may represent different directions that are not perpendicular to one another. For the purposes of this disclosure, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ. As used herein, the term "and/or" includes any and all combinations of one or more of the associated listed items.

Although the terms "first," "second," etc. may be used herein to describe various types of elements, these elements should not be limited by these terms. These terms are used to distinguish one element from another element. Thus, a first element discussed below could be termed a second element without departing from the teachings of the disclosure.

Spatially relative terms, such as "beneath," "below," "under," "lower," "above," "upper," "over," "higher," "side" (e.g., as in "sidewall"), and the like, may be used herein for descriptive purposes, and, thereby, to describe one elements relationship to another element(s) as illustrated in the drawings. Spatially relative terms are intended to encompass different orientations of an apparatus in use, operation, and/or manufacture in addition to the orientation depicted in the drawings. For example, if the apparatus in the drawings is turned over, elements described as "below" or "beneath" other elements or features would then be oriented "above" the other elements or features. Thus, the term "below" can encompass both an orientation of above and below. Furthermore, the apparatus may be otherwise oriented (e.g., rotated 90 degrees or at other orientations), and, as such, the spatially relative descriptors used herein interpreted accordingly.

The terminology used herein is for the purpose of describing particular embodiments and is not intended to be limiting. As used herein, the singular forms, "a," "an," and "the" are intended to include the plural forms as well, unless the context clearly indicates otherwise. Moreover, the terms "comprises," "comprising," "includes," and/or "including," when used in this specification, specify the presence of stated features, integers, steps, operations, elements, components, and/or groups thereof, but do not preclude the presence or addition of one or more other features, integers, steps, operations, elements, components, and/or groups thereof. It is also noted that, as used herein, the terms "substantially," "about," and other similar terms, are used as terms of approximation and not as terms of degree, and, as such, are utilized to account for inherent deviations in measured, calculated, and/or provided values that would be recognized by one of ordinary skill in the art.

As customary in the field, some embodiments are described and illustrated in the accompanying drawings in terms of functional blocks, units, and/or modules. Those skilled in the art will appreciate that these blocks, units, and/or modules are physically implemented by electronic (or optical) circuits, such as logic circuits, discrete components, microprocessors, hard-wired circuits, memory elements, wiring connections, and the like, which may be formed using semiconductor-based fabrication techniques or other manufacturing technologies. In the case of the blocks, units, and/or modules being implemented by microprocessors or other similar hardware, they may be programmed and controlled using software (e.g., microcode) to perform various functions discussed herein and may optionally be driven by firmware and/or software. It is also contemplated that each block, unit, and/or module may be implemented by dedicated hardware, or as a combination of dedicated hardware to perform some functions and a processor (e.g., one or more programmed microprocessors and associated circuitry) to perform other functions. Also, each block, unit, and/or module of some embodiments may be physically separated into two or more interacting and discrete blocks, units, and/or modules without departing from the scope of the inventive concepts. Further, the blocks, units, and/or modules of some embodiments may be physically combined into more complex blocks, units, and/or modules without departing from the scope of the inventive concepts.

Unless otherwise defined, all terms (including technical and scientific terms) used herein have the same meaning as commonly understood by one of ordinary skill in the art to which this disclosure is a part. Terms, such as those defined in commonly used dictionaries, should be interpreted as having a meaning that is consistent with their meaning in the context of the relevant art and should not be interpreted in an idealized or overly formal sense, unless expressly so defined herein.

Hereinafter, embodiments will be explained in detail with reference to the accompanying drawings.

FIG. 1 is a perspective view showing an electronic device ED according to an embodiment.

Referring to FIG. 1, the electronic device ED may include a display panel DP. The display panel DP may include a display area DA and a non-display area NDA, which are defined therein. The non-display area NDA may be defined adjacent to the display area DA.

The display area DA may be an area in which an image is displayed. The non-display area NDA may be an area in which an image is not displayed. A plurality of pixels PX may be arranged in the display area DA. The pixels PX may mean effective pixels for displaying an image.

The display area DA may be substantially parallel to a plane defined by a first direction DR1 and a second direction DR2 intersecting the first direction DR1. A third direction DR3 may indicate substantially a normal line direction of the display area DA, i.e., a thickness direction DR3 of the display panel DP. Front (e.g., upper) and rear (e.g., lower) surfaces of each member of the electronic device ED may be defined with respect to the third direction DR3. The expression "when viewed in plane" may mean a state of being viewed in the third direction DR3.

The display panel DP may be applied to a large-sized display device, such as a television set, a monitor, or an outdoor billboard, and a small and medium-sized display device, such as a personal computer, a notebook computer, a personal digital assistant, a car navigation unit, a game unit, a mobile electronic device, or a camera. However, these are merely examples, and the display panel DP may be applied to other electronic devices as long as they do not depart from the concept of embodiments.

According to an embodiment, the display panel DP may be a light emitting type display panel. However, embodiments are not be limited thereto. For example, the display panel DP may be an organic light emitting display panel, an inorganic light emitting display panel, a micro-LED display panel, or a nano-LED display panel. A light emitting element of the organic light emitting display panel may include an organic light emitting material. A light emitting element of the inorganic light emitting display panel may include a quantum dot or a quantum rod. A light emitting element of the micro-LED display panel may include a micro-LED element. A light emitting element of the nano-LED display panel may include a nano-LED element.

A bezel area of the display panel DP may be defined by the non-display area NDA. The non-display area NDA may be defined adjacent to the display area DA. The non-display area NDA may surround the display area DA. However, embodiments are not limited thereto or thereby. A shape of the display area DA and a shape of the non-display area NDA may be designed to have various shapes relative to each other. According to an embodiment, the non-display area NDA may be omitted.

Figure 2:
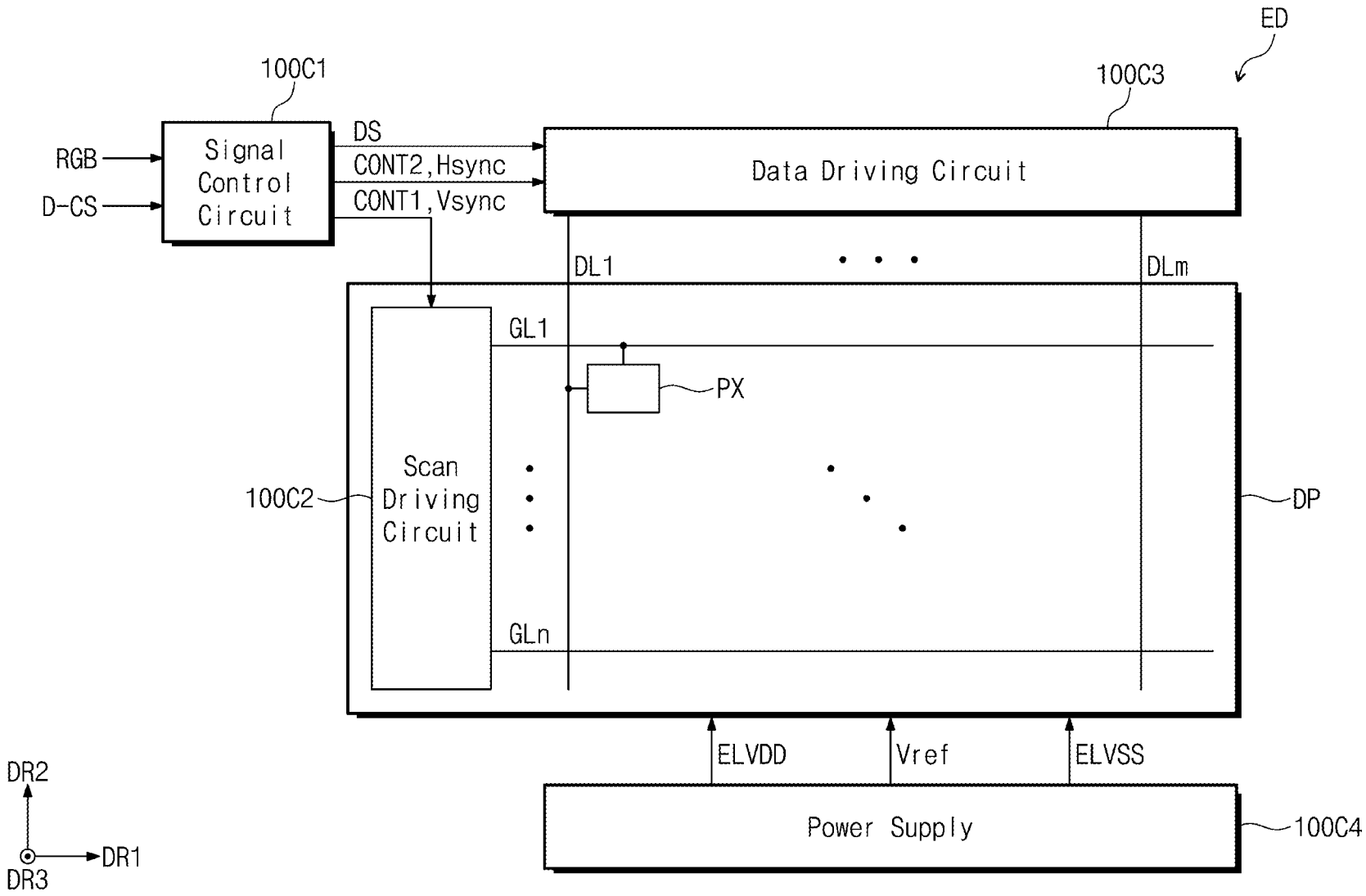
FIG. 2 is a block diagram of the electronic device of FIG. 1.

FIG. 2 is a block diagram showing the electronic device ED according to an embodiment.

Referring to FIG. 2, the display panel DP may include a plurality of scan lines GL1 to GLn, a plurality of data lines DL1 to DLm, and the pixels PX. Each of the pixels PX may be connected to a corresponding data line among the data lines DL1 to DLm and a corresponding scan line among the scan lines GL1 to GLn, however, this is merely one example. According to an embodiment, the display panel DP may further include light emitting control lines, and the electronic device ED may further include a light emitting driving circuit for applying control signals to the light emitting control lines. The configurations of the display panel DP should not be particularly limited thereto.

The electronic device ED may further include a signal control circuit 100C1, a scan driving circuit 100C2, a data driving circuit 100C3, and a power supply 100C4.

The signal control circuit 100C1 may receive image data RGB and a control signal D-CS from an external source. The control signal D-CS may include a variety of signals. As an example, the control signal D-CS may include an input vertical synchronization signal, an input horizontal synchronization signal, a main clock, and a data enable signal.

The signal control circuit 100C1 may generate a first control signal CONT1 and a vertical synchronization signal Vsync in response to the control signal D-CS and may output the first control signal CONT1 and the vertical synchronization signal Vsync to the scan driving circuit 100C2. The vertical synchronization signal Vsync may be included in the first control signal CONT1.

The signal control circuit 100C1 may generate a second control signal CONT2 and a horizontal synchronization signal Hsync in response to the control signal D-CS and may output the second control signal CONT2 and the horizontal synchronization signal Hsync to the data driving circuit 100C3. The horizontal synchronization signal Hsync may be included in the second control signal CONT2.

In addition, the signal control circuit 100C1 may output a data signal DS, which is generated by processing the image data RGB according to an operational condition of the display panel DP, to the data driving circuit 100C3. The first control signal CONT1 and the second control signal CONT2 are required for the operation of the scan driving circuit 100C2 and the data driving circuit 100C3. However, embodiments are not limited thereto.

The scan driving circuit 100C2 may drive the scan lines GL1 to GLn in response to the first control signal CONT1 and the vertical synchronization signal Vsync. According to an embodiment, the scan driving circuit 100C2 may be formed through the same process as layers of a pixel (refer to FIG. 3) of the display panel DP. However, embodiments are not limited thereto or thereby. As an example, the scan driving circuit 100C2 may be directly mounted in a predetermined area of the display panel DP after being implemented as an integrated circuit (IC) or may be mounted on a separate printed circuit board in a chip-on-film (COF) method to be electrically connected to the display panel DP.

The data driving circuit 100C3 may output grayscale voltages in response to the second control signal CONT2, the horizontal synchronization signal Hsync, and the data signal DS from the signal control circuit 100C1 to drive the data lines DL1 to DLm. The data driving circuit 100C3 may be directly mounted in a predetermined area of the display panel DP after being implemented as an integrated circuit (IC) or may be mounted on a separate printed circuit board in a chip-on-film (COF) method to be electrically connected to the display panel DP. However, embodiments are not limited thereto. As an example, the data driving circuit 100C3 may be formed through the same process as the layers of the pixel (refer to FIG. 3) of the display panel DP.

The data driving circuit 100C3 may include an analog-to-digital converter ADC. The analog-to-digital converter ADC will be described later.

The power supply 100C4 may supply a voltage to the display panel DP. The power supply 100C4 may supply a first power ELVDD, a second power ELVSS, and a reference voltage Vref to the pixels PX. The first power ELVDD may have a voltage level higher than that of the second power ELVSS. The reference voltage Vref may be an initialization voltage that initializes a gate electrode of a first transistor. The first power ELVDD may have a voltage from about 3 volts (V) to about 6 volts (V), and the second power ELVSS may have a voltage from about −7 volts to about 0 volts, however, these are merely examples. According to an embodiment, the voltage of the first power ELVDD and the voltage of the second power ELVSS may be changed in various ways in a voltage range that is able to drive the display panel DP.

Figure 3:
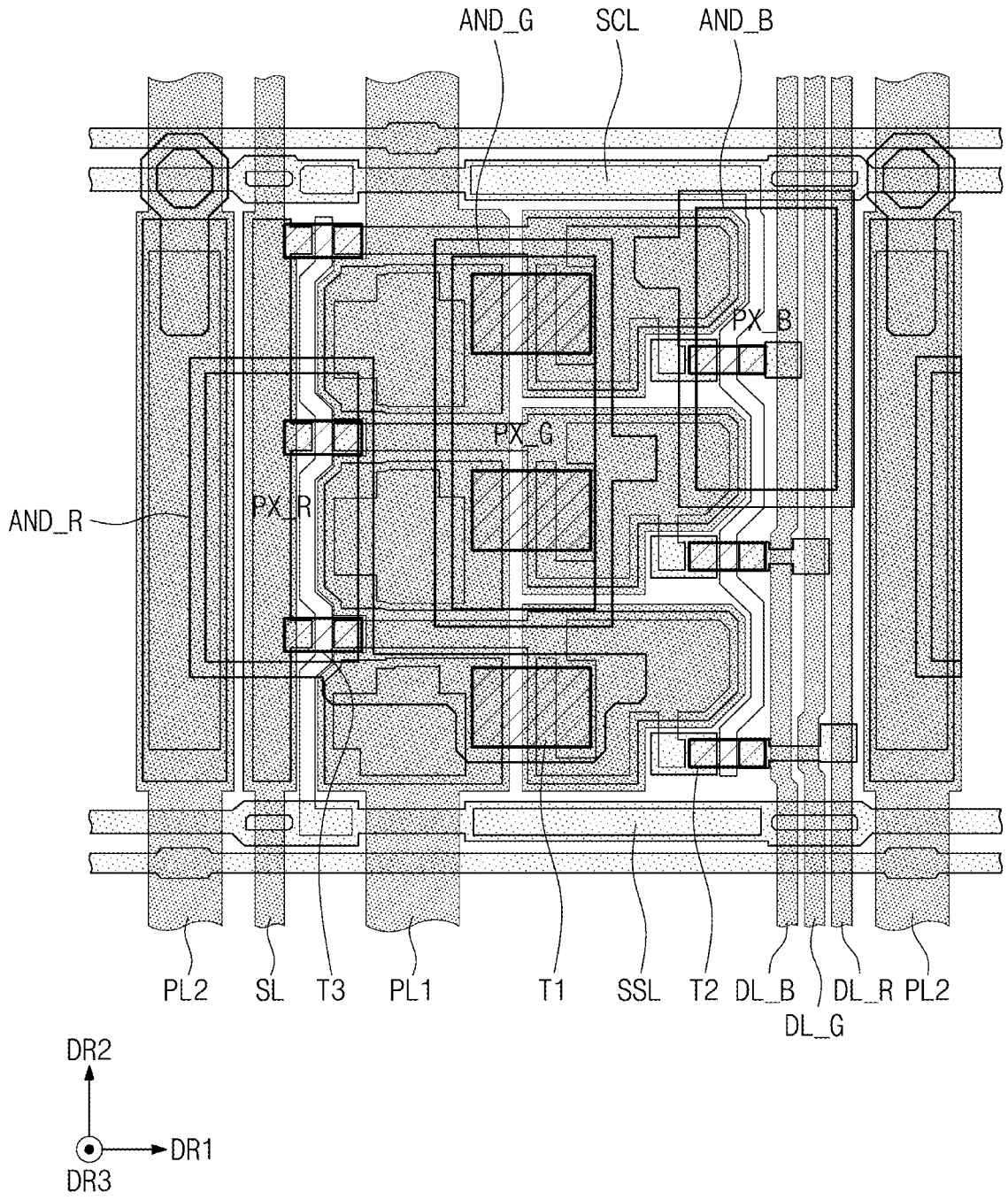
FIG. 3 is a layout of a representative pixel of the electronic device of FIG. 1.
Figure 4:
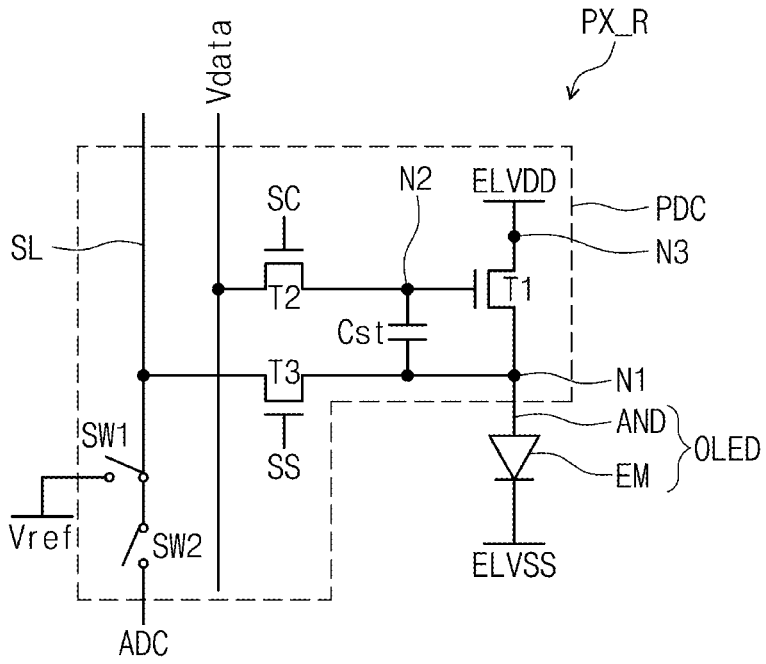
FIG. 4 is an equivalent circuit diagram of the representative pixel of FIG. 3.

FIG. 3 is a layout of a pixel according to an embodiment, and FIG. 4 is an equivalent circuit diagram showing a pixel PX_R according to an embodiment.

Referring to FIGS. 3 and 4, the pixels PX may include a first pixel PX_R, a second pixel PX_G, and a third pixel PX_B. The first pixel PX_R may emit a red light. The second pixel PX_G may emit a green light. The third pixel PX_B may emit a blue light.

The data lines DL1 to DLm may include a first data line DL_R, a second data line DL_G, and a third data line DL_B. Each of the first data line DL_R, the second data line DL_G, and the third data line DL_B may extend in the second direction DR2. For example, the first data line DL_R, the second data line DL_G, and the third data line DL_B may be arranged in the first direction DR1.

A first power line PL1 may extend in the second direction DR2. The first power ELVDD may be applied to the first power line PL1.

A second power line PL2 may extend in the second direction DR2. The second power ELVSS may be applied to the second power line PL2.

A reference voltage line SL may be disposed between the first power line PL1 and the second power line PL2. The reference voltage line SL may extend in the second direction DR2. When viewed in plane, the reference voltage line SL may overlap at least a portion of a first electrode AND_R of the first pixel PX_R, however, the layout of the pixel should not be limited thereto or thereby. For example, the reference voltage line SL may overlap a portion of a first electrode AND_G of the second pixel PX_G and a portion of a first electrode AND_B of the third pixel PX_B.

The scan lines GL1 to GLn may include a first scan line SCL and a second scan line SSL.

The first scan line SCL may extend in the first direction DR1. The first scan line SCL may receive a scan signal SC.

The second scan line SSL may extend in the first direction DR1. The second scan line SSL may receive a sensing signal SS.

FIG. 4 shows the equivalent circuit diagram of the first pixel PX_R. Further, the equivalent circuit diagram of FIG. 4 may be applied to the second pixel PX_G and the third pixel PX_B.

The first pixel PX_R may include a pixel driving circuit PDC and a light emitting diode OLED.

According to an embodiment, the pixel driving circuit PDC may include three transistors and one capacitor. A structure of the pixel PX-R configured to include three transistors and one capacitor as described above may be called a 3T1C structure, however, this is merely one example. According to embodiments, the number of the transistors and the number of the capacitors of the pixel driving circuit PDC may be varied or modified.

The pixel driving circuit PDC may include a driving transistor T1, a switching transistor T2, a sensing transistor T3, a capacitor Cst, and the reference voltage line SL.

The light emitting diode OLED may be operated in an on-state (e.g., a light on-state mode) or an off-state (e.g., a light off-state mode). The light emitting diode OLED may include a first electrode AND, a light emitting element EM, and a second electrode. The first electrode AND may be referred to as an anode AND. The second electrode may be referred to as a cathode. For example, the light emitting diode OLED may emit light in the on-state, and the light emitting diode OLED may not emit light in the off-state.

The first electrode AND may be electrically connected to a source node or a drain node of the driving transistor T1. The second power ELVSS may be applied to the second electrode.

The driving transistor T1 may supply a driving current to the light emitting diode OLED to drive the light emitting diode OLED.

The driving transistor T1 may include a first node N1 corresponding to the source node or the drain node, a second node N2 corresponding to a gate node, and a third node N3 corresponding to the drain node or the source node. FIG. 4 shows the driving transistor T1 including the first node N1, the second node N2, and the third node N3, which respectively correspond to the source node, the gate node, and the drain node of the driving transistor T1.

The first node N1 may be electrically connected to the first electrode AND of the light emitting diode OLED. The first power ELVDD may be applied to the third node N3.

The switching transistor T2 may apply a data voltage Vdata to the second node N2 of the driving transistor T1. The switching transistor T2 may be controlled by the scan signal SC, which is applied to a gate node of the switching transistor T2, and may be electrically connected between the second node N2 of the driving transistor T1 and the data line.

The capacitor Cst may be electrically connected between the first node N1 and the second node N2 of the driving transistor T1. The capacitor Cst may be referred to as a storage capacitor Cst. The capacitor Cst may maintain a uniform voltage (e.g., a constant voltage) for one frame period.

The sensing transistor T3 may be controlled by the sensing signal SS, which is applied to a gate node of the sensing transistor T3, and may be electrically connected between the reference voltage line SL and the first node N1.

The sensing transistor T3 may be turned on such that the reference voltage Vref, which is applied thereto via the reference voltage line SL, is applied to the first node N1 of the driving transistor T1.

In addition, the sensing transistor T3, which is turned on, may connect the analog-to-digital converter ADC, which is electrically connected to the reference voltage line SL, to the first node N1 of the driving transistor T1 such that a voltage of the first node N1 of the driving transistor T1 is sensed by the analog-to-digital converter ADC.

The sensing transistor T3 may be a transistor that is used for a compensation function with respect to the inherent characteristics of the driving transistor T1. The inherent characteristics of the driving transistor T1 may include, for example, a threshold voltage Vth, a mobility, and the like.

The sensing transistor T3 may be used to sense the inherent characteristics (e.g., a threshold voltage Vth) of the driving transistor T1 of each of the pixels PX by using a source following operation of the driving transistor T1, in which a voltage Vs of the first node N1 follows a voltage Vg of the second node N2 with the voltage difference therebetween corresponding to, e.g., the threshold voltage Vth of the driving transistor T1. For example, the sensing transistor T3 may be used to sense the voltage of the first node N1 of the driving transistor T1 as a sensing voltage. In this case, a variation in threshold voltage of the driving transistor T1 may be sensed based on the sensing voltage.

As an example, a constant voltage may be applied to the second node N2 of the driving transistor T1 to define the inherent characteristics, e.g., the threshold voltage Vth or current capability of the driving transistor T1. The threshold voltage Vth or the current capability of the driving transistor T1 (i.e., the mobility) may be relatively determined through an amount of voltage charged for a certain time, and a compensation gain for compensation may be calculated based on the determined threshold voltage Vth or the current capability. The compensation for the mobility through the sensing of the mobility may be performed by spending a certain amount of time for driving the screen. Accordingly, parameters of the driving transistor T1, which are changed in real time, may be sensed and compensated for. This will be described later.

According to an embodiment, in each of the pixels PX, the inherent characteristics (e.g., the threshold voltage Vth, the mobility, etc.) of the driving transistor T1 may be sensed by the analog-to-digital converter ADC through the sensing transistor T3. As the inherent characteristics between the driving transistors T1 may be compensated for, the luminance uniformity of the display panel DP may be improved. Accordingly, the display quality of the electronic device ED (refer to FIG. 1) may be improved.

The pixel driving circuit PDC may be electrically connected to the analog-to-digital converter ADC.

The analog-to-digital converter ADC may sense a voltage of the reference voltage line SL, may convert the sensed voltage to a digital value to generate sensing data, and may transmit the generated sensing data to the signal control circuit 100C1 (refer to FIG. 2).

The analog-to-digital converter ADC may provide the sensing data to the signal control circuit 100C1 (refer to FIG. 2) such that the signal control circuit 100C1 may calculate a compensation value on a digital basis and compensate for the sensing data.

The pixel driving circuit PDC may further include a first switch SW1 and a second switch SW2.

The first switch SW1 may electrically connect the reference voltage line SL and a supply node of the reference voltage Vref in response to a first switching signal.

The second switch SW2 may electrically connect the reference voltage line SL and the analog-to-digital converter ADC in response to a second switching signal (sampling signal).

When the first switch SW1 is in an off-state and the second switch SW2 is in an on-state, the reference voltage line SL may be connected to the analog-to-digital converter ADC, and thus, the analog-to-digital converter ADC may sense the voltage of the reference voltage line SL.

Figure 5A:
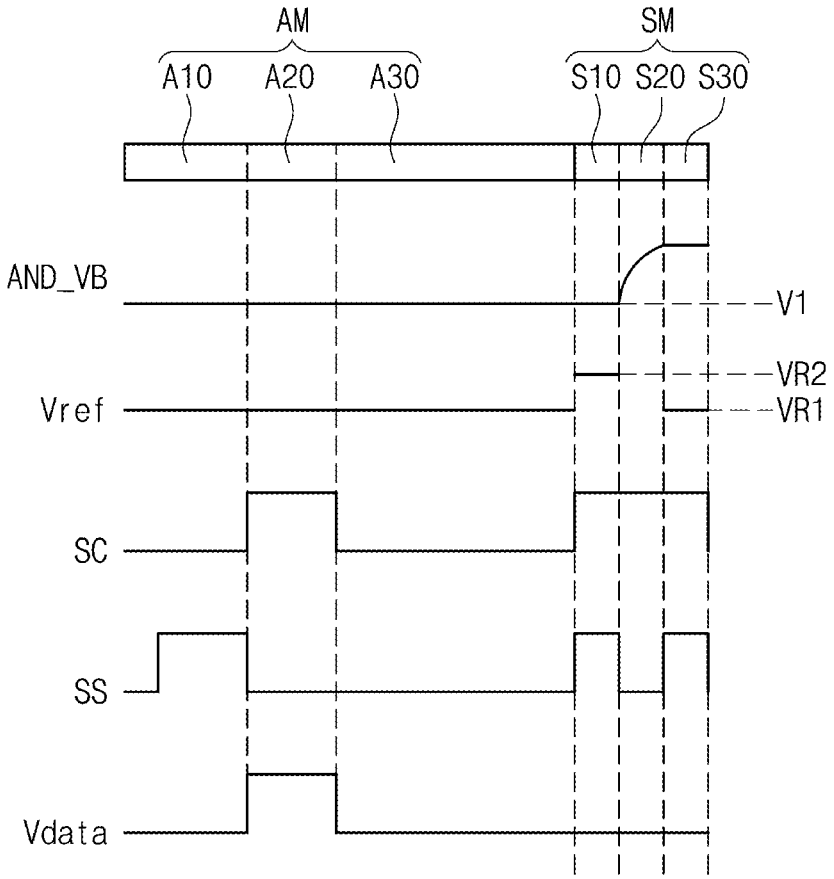
FIGS. 5A and 5B are waveform diagrams illustrating driving signals to drive the pixel of FIG. 4.
Figure 5B:
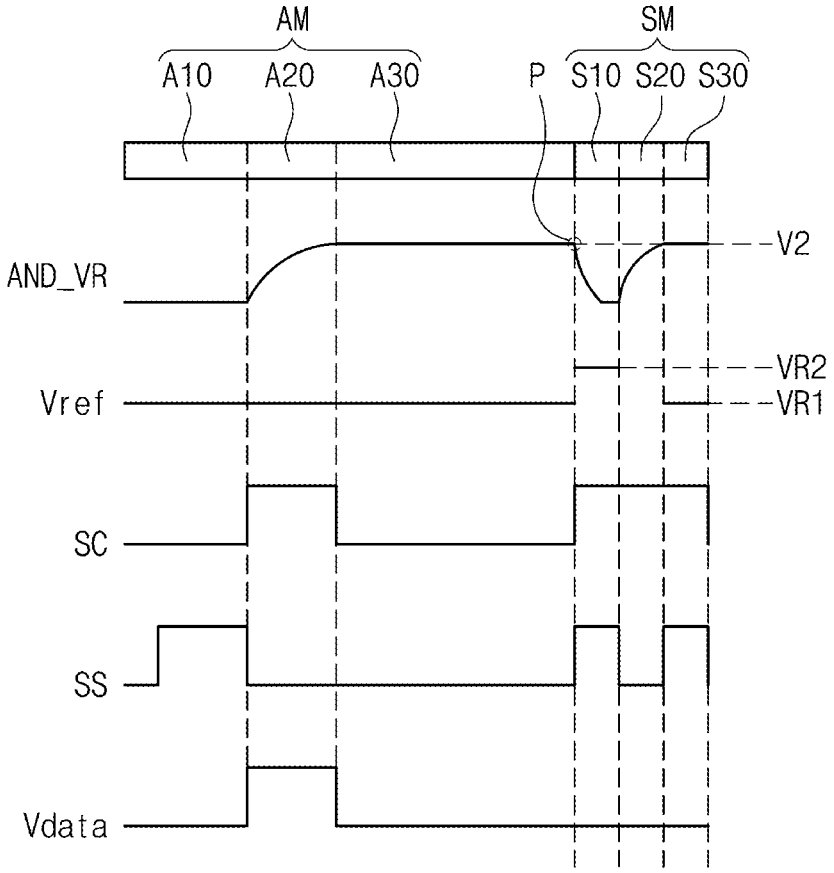

FIGS. 5A and 5B are waveform diagrams showing driving signals to drive the pixel according to an embodiment.

Referring to FIGS. 3, 4, 5A, and 5B, the pixel driving circuit PDC may operate in a light emitting mode AM or a sensing mode SM. The light emitting mode AM may be a driving mode in which the light emitting diode OLED emits a light.

The reference voltage Vref may be applied to the reference voltage line SL. The reference voltage Vref may include a first reference voltage VR1 and a second reference voltage VR2. The second reference voltage VR2 may be different from the first reference voltage VR1. The second reference voltage VR2 may be referred to as a third voltage VR2.

The light emitting mode may include an initialization period A10, a recording period A20, and a light emitting period A30.

The first node N1 of the driving transistor T1 may be initialized in the initialization period A10. To this end, the first reference voltage VR1 may be applied to the reference voltage line SL as an initialization voltage. As an example, the first reference voltage VR1 may have a voltage level of about 2 volts. The sensing signal SS may be applied to the gate node of the sensing transistor T3. Thus, the sensing transistor T3 may be turned on by the sensing signal SS. The first reference voltage VR1 may be applied to the first node N1 of the driving transistor T1 through the sensing transistor T3, which is turned on. The reference voltage Vref provided during the initialization period A10 may be determined by taking into account a peak/black current and a voltage output capability of the data driving circuit 100C3.

The scan signal SC may be applied to a gate node of the switching transistor T2 in the recording period A20. Thus, the switching transistor T2 may be turned on. The data voltage Vdata may be applied to the second node N2 of the driving transistor T1 through the switching transistor T2, which is turned on. Accordingly, a constant electric potential difference (e.g., Vdata−VR1) may occur between the second node N2 and the first node N1 of the driving transistor T1 in the recording period A20. For example, the constant electric potential difference (e.g., Vdata−VR1) may occur across the capacitor Cst, and thus, electric charges may be charged in the capacitor Cst by the constant electric potential difference (e.g., Vdata−VR1) in the recording period A20.

When the switching transistor T2 and the sensing transistor T3 are substantially simultaneously turned off in the light emitting period A30, the first node N1 and the second node N2 of the driving transistor T1 may be floated (e.g., in a floating state), and a voltage may be boosted while maintaining the constant electric potential difference (e.g., Vdata−VR1). Accordingly, when the voltage of the first node N1 of the driving transistor T1 becomes higher than a certain voltage (e.g., a minimum threshold voltage of the light emitting diode OLED), a current may flow through the light emitting diode OLED, and thus, the light emitting diode OLED may emit the light.

FIG. 5A is a waveform diagram showing the driving signals to drive the light emitting diode OLED in the off-state (e.g., in the light off-state mode). For example, the light emitting diode OLED may not emit light in the off-state.

The data voltage Vdata may be applied to the second node N2 of the driving transistor T1. In this case, the data voltage Vdata may have a first voltage V1 in the off-state. The first electrode AND_R of the light emitting diode OLED operated in the off-state may have a first anode voltage AND VB. Due to the data voltage Vdata provided as the first voltage V1, the first pixel PX_R may display a black image. The first voltage V1 may have substantially the same voltage level as that of the first reference voltage VR1. As an example, the first voltage V1 may have a voltage level of about 2 volts. Accordingly, the constant electric potential difference (e.g., Vdata−VR1) may not occur. For example, the constant electric potential difference (e.g., Vdata−VR1) may be substantially 0 volt, and thus, the light emitting diode OLED may not emit the light in the light emitting period A30. The light emitting diode OLED may display the black image.

FIG. 5B is a waveform diagram showing the driving signals to drive the light emitting diode OLED operated in the on-state (e.g., in the light on-state mode).

The data voltage Vdata may be applied to the second node N2 of the driving transistor T1 in the on-state. In this case, the driving transistor T1 may provide a second voltage V2, which is different from the first voltage V1, to the first node N1 based on the data voltage Vdata, e.g., through the source following operation of the driving transistor T1. For example, the second voltage V2 may be higher than the first voltage V1. As an example, the second voltage V2 may have a voltage level of about 14 volts. The first electrode AND_R of the light emitting diode OLED operated in the on-state may have a second anode voltage AND_VR, e.g., corresponding to the second voltage V2. Due to the data voltage Vdata applied to the second node N2, by which the second voltage V2 is generated at the first node N1, the first pixel PX R may display a red or white image. For example, when the constant electric potential difference (e.g., Vdata−VR1) occurs and the voltage of the first node N1 of the driving transistor T1 becomes higher than a certain voltage (e.g., a minimum threshold voltage of the light emitting diode OLED), the current may flow through the light emitting diode OLED, and thus, the light emitting diode OLED may emit the light.

The sensing mode SM may be a mode to compensate for the threshold voltage and the mobility of the driving transistor T1 of each of the pixels PX.

The sensing mode SM may include an initialization period S10, a sensing period S20, and a rewriting period S30. This will be described later.

The data voltage Vdata may be applied to the second node N2 of the driving transistor T1 through the data line to compensate for the threshold voltage Vth and the mobility of the driving transistor T1. The second reference voltage VR2 may be applied to the first node N1 of the driving transistor T1 via the reference voltage line SL. The second anode voltage AND_VR may be initialized after a first point P by the second reference voltage VR2. Then, the first node N1 of the driving transistor T1 may be floated (e.g., in a floating state), and thus, the voltage of the first node N1 may be changed and then may become constant or settled. The analog-to-digital converter ADC may measure the voltage (Vdata−Vth), which becomes constant or settled, via the reference voltage line SL. Thus, the analog-to-digital converter ADC may sense the threshold voltage Vth of the driving transistor T1 based on the data voltage Vdata. Compensation may be performed by adding a threshold voltage Vth to each data voltage Vdata based on the sensed threshold voltage Vth. This will be described later.

The waveforms shown in FIGS. 5A and 5B are merely examples, and the waveform of each driving signal used to drive the pixels should not be limited thereto or thereby as long as they are appropriate to drive the pixels PX.

Figure 6:
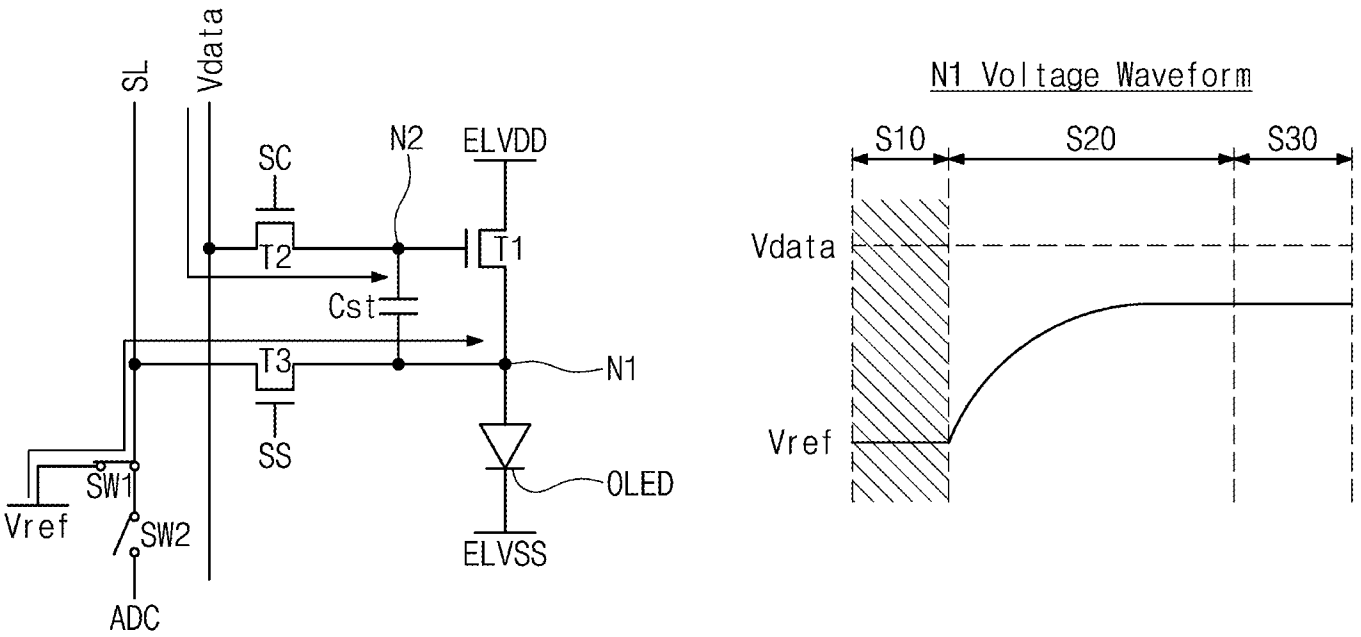
FIG. 6 is a schematic view illustrating a driving operation of the pixel of FIG. 4 in an initialization period of a sensing mode and a voltage waveform of a first node according to an embodiment.

FIG. 6 is a view showing a driving operation of the pixel in the initialization period S10 of the sensing mode and a voltage waveform of the first node N1 according to an embodiment. In FIG. 6, the same reference numerals denote the same elements in FIG. 4, and thus, detailed descriptions of the same elements will be omitted for descriptive convenience.

Referring to FIGS. 5A, 5B, and 6, the first node N1 and the second node N2 of the driving transistor T1 may be initialized to a certain voltage in the initialization period S10.

In the initialization period S10, the switching transistor T2 and the sensing transistor T3 may be in the on-state. The first switch SW1 may be in the on-state, and the second switch SW2 may be in the off-state. For example, the reference voltage line SL may receive the reference voltage Vref and may not be connected to the analog-to-digital converter ADC.

The second reference voltage VR2 applied to the reference voltage line SL may be applied to the first node N1 of the driving transistor T1 via the sensing transistor T3, which is turned on. The second reference voltage VR2 may be higher than the first reference voltage VR1. The second reference voltage VR2 may be higher than the first voltage V1 and may be lower than the second voltage V2. For example, the second reference voltage VR2 may have a value between the first voltage V1 (e.g., 2 volts) and the second voltage V2 (e.g., 14 volts). As an example, the second reference voltage VR2 may have a voltage level of about 8 volts. The first node N1 of the driving transistor T1 may be initialized to the second reference voltage VR2.

The data voltage Vdata may be applied to the second node N2 of the driving transistor T1 via the switching transistor T2, which is turned on. Accordingly, the second node N2 of the driving transistor T1 may be initialized to the data voltage Vdata.

Figure 7:
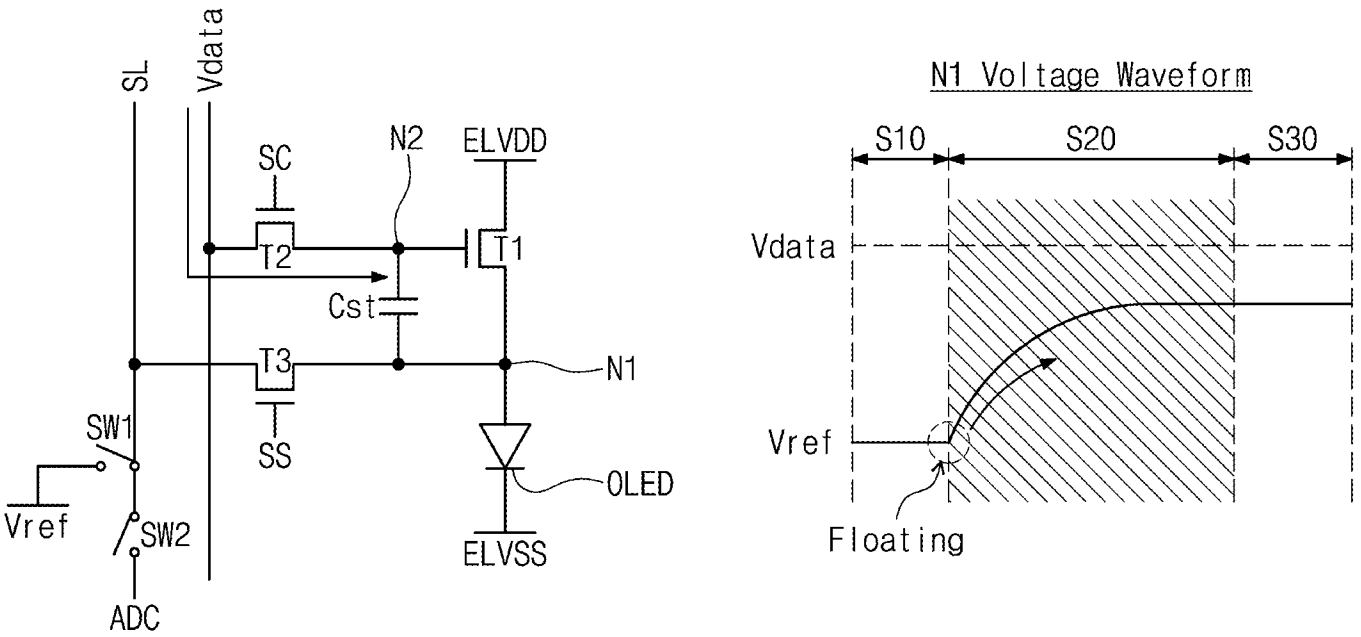
FIG. 7 is a schematic view illustrating a driving operation of the pixel of FIG. 4 in a sensing period of a sensing mode and a voltage waveform of a first node according to an embodiment.

FIG. 7 is a view showing a driving operation of the pixel in the sensing period S20 of the sensing mode and a voltage waveform of the first node N1 according to an embodiment. In FIG. 7, the same reference numerals denote the same elements in FIG. 4, and thus, detailed descriptions of the same elements will be omitted for descriptive convenience.

Referring to FIGS. 5A, 5B and 7, the voltage of the first node N1 of the driving transistor T1 may be boosted in the sensing period S20.

In the sensing period S20, the switching transistor T2 may be in the on-state, and the sensing transistor T3 may be in the off-state. The first switch SW1 and the second switch SW2 may be in the off-state. For example, the reference voltage line SL may not receive the reference voltage Vref and may not be connected to the analog-to-digital converter ADC.

In the sensing period S20, the reference voltage Vref may be in a floating state.

As the second switch SW2 is in the off-state, the reference voltage Vref may not be applied to the first node N1 of the driving transistor T1. For example, the first node N1 of the driving transistor T1 may be floated (e.g., in a floating state).

In the sensing period S20, the voltage of the first node N1 of the driving transistor T1 may be boosted or increased.

The voltage of the first node N1 of the driving transistor T1 may be saturated or settled at the voltage (Vdata−Vth), which is obtained by subtracting the threshold voltage Vth of the driving transistor T1 from the voltage Vdata of the second node N2 of the driving transistor T1.

After the voltage of the first node N1 of the driving transistor T1 is saturated or settled, the voltage of the first node N1 of the driving transistor T1 may be sensed to sense the threshold voltage Vth of the driving transistor T1.

For example, the rewriting period S30 may proceed after the voltage of the first node N1 of the driving transistor T1 is saturated or settled.

Figure 8:
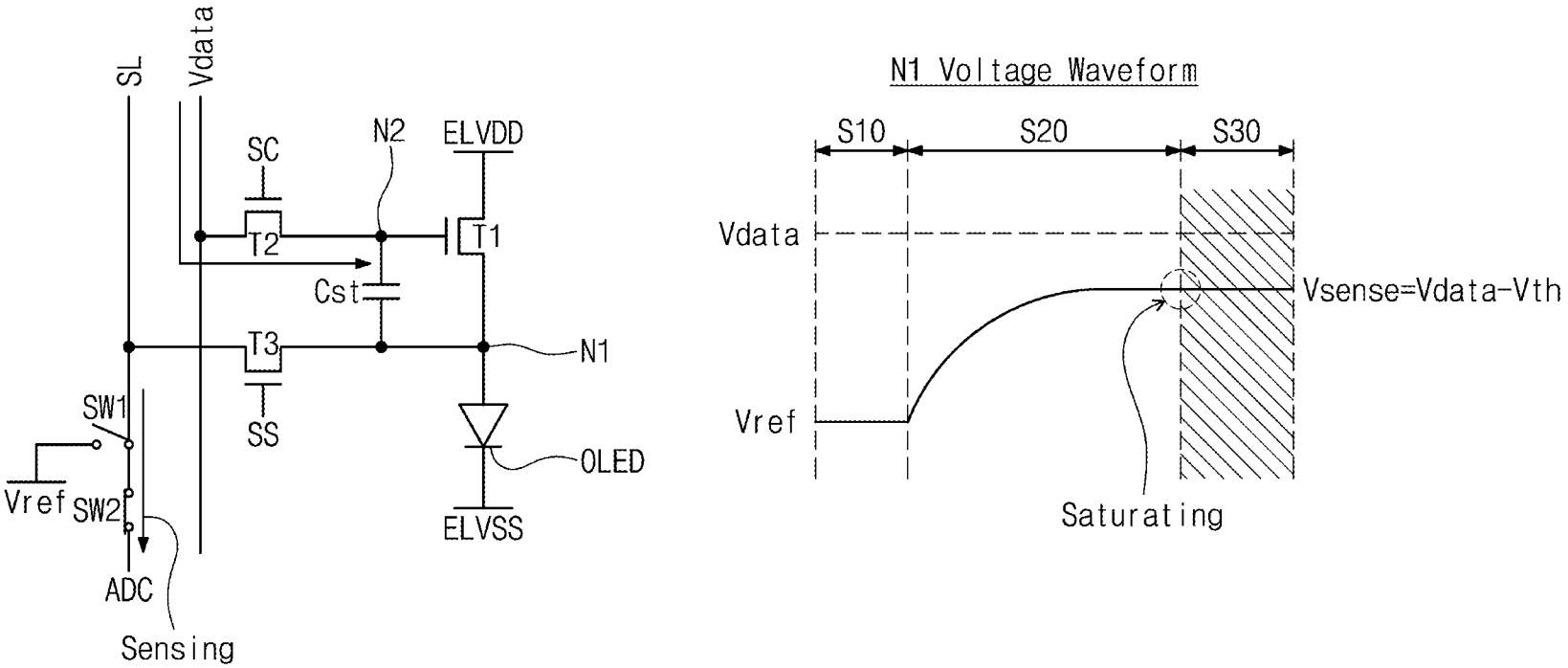
FIG. 8 is a schematic view illustrating a driving operation of the pixel of FIG. 4 in a rewriting period and a voltage waveform of a first node according to an embodiment.

FIG. 8 is a view showing a driving operation of the pixel in the rewriting period S30 and a voltage waveform of the first node N1 according to an embodiment. In FIG. 8, the same reference numerals denote the same elements in FIG. 4, and thus, detailed descriptions of the same elements will be omitted for descriptive convenience.

Referring to FIGS. 5A, 5B, and 8, the first switch SW1 may be in the off-state in the rewriting period S30, and the second switch SW2 may be in the on-state in the rewriting period S30. The sensing transistor T3 may be in the on-state.

As the second switch SW2 is in the on-state, the analog-to-digital converter ADC may be electrically connected to the reference voltage line SL and may sample the voltage of the reference voltage line SL.

The threshold voltage Vth of the driving transistor T1 of each of the pixels PX (refer to FIG. 1) may be determined based on the voltage Vsense, which is sensed by the analog-to-digital converter ADC, and a difference in threshold voltage of the driving transistors T1 may be determined or measured. For example, the voltage Vsense may be a voltage level obtained by subtracting the threshold voltage Vth of driving transistor T1 from the data voltage Vdata.

The analog-to-digital converter ADC may convert the sensed voltage Vsense to the digital value and generate the sensing data, may determine the difference in threshold voltage based on the generated sensing data, and may determine and store a data compensation value with respect to each of the pixels PX (refer to FIG. 1). The data compensation value may be used to compensate for the difference in threshold voltage.

The signal control circuit 100C1 (refer to FIG. 2) may change the image data based on the data compensation value. The data driving circuit 100C3 (refer to FIG. 2) may convert the compensated image data to the data voltage using a digital-to-analog converter DAC and may output the data voltage to corresponding data lines. Through this, the compensation operation is substantially performed.

FIGS. 6, 7, and 8 show the sensing operation to compensate for the threshold voltage Vth as a representative example, however, the sensing operation in the sensing mode SM should not be limited thereto or thereby and may be applied to various sensing operations.

Figure 9:
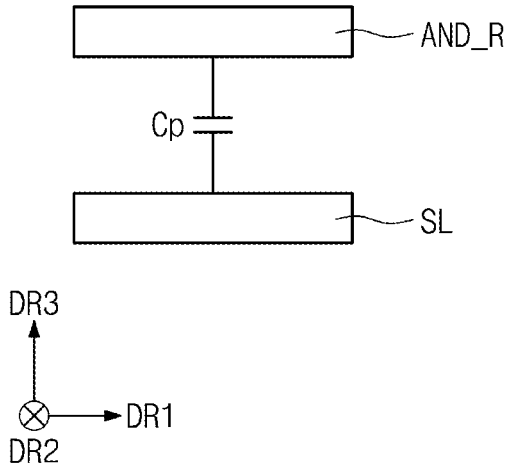
FIG. 9 is a schematic view illustrating a first electrode and a reference voltage line according to an embodiment.
Figure 10:
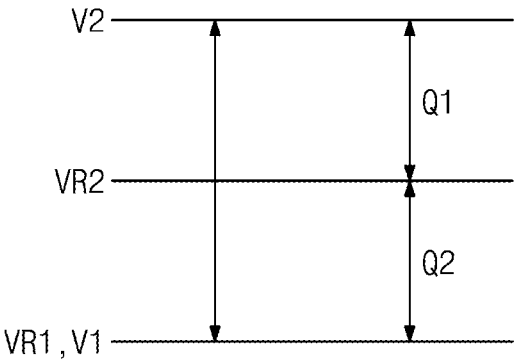
FIG. 10 is a schematic view illustrating voltage values of a first voltage, a second voltage, a first reference voltage, and a second reference voltage according to an embodiment.

FIG. 9 is a view schematically showing the first electrode AND_R and the reference voltage line SL according to an embodiment, and FIG. 10 is a view showing voltage values of the first voltage V1, the second voltage V2, the first reference voltage VR1, and the second reference voltage VR2 according to an embodiment.

Referring to FIGS. 3, 5A, 5B, 9, and 10, at least a portion of the first electrode AND_R of the first pixel PX_R may overlap the reference voltage line SL when viewed in plane. A parasitic capacitance Cp may be formed between the first electrode AND_R and the reference voltage line SL.

The parasitic capacitance Cp may include a first parasitic capacitance Q2 and a second parasitic capacitance Q1.

The parasitic capacitance Q2 may be formed between the first electrode AND_R and the reference voltage line SL after the first pixel PX R displays the black image.

In the light emitting period A30 of the light emitting mode AM displaying the black image, the first voltage V1 may be applied to the first electrode AND_R of the first pixel PX_R. The first voltage V1 may have substantially the same voltage level as that of the first reference voltage VR1. For example, the first voltage V1 may have a voltage level of about 2 volts.

In the initialization period S10 of the sensing mode SM, the second reference voltage VR2 may be applied to the reference voltage line SL.

The second reference voltage VR2 may have a voltage level higher than that of the first reference voltage VR1. The second reference voltage VR2 may have the voltage level higher than that of the first voltage V1 and lower than that of the second voltage V2. For example, the second reference voltage VR2 may have a voltage level between the first voltage V1 and the second voltage V2.

The second reference voltage VR2 may have an average value between the first voltage V1 and the second voltage V2. For example, the second reference voltage VR2 may have a value obtained by dividing a sum of the first voltage V1 and the second voltage V2 by 2. For example, the second reference voltage VR2 may have a voltage level of about 8 volts.

The first parasitic capacitance Q2 may be formed by the first voltage V1 and the second reference voltage VR2.

The second parasitic capacitance Q1 may be formed between the first electrode AND_R and the reference voltage line SL after the first pixel PX_R displays the red or while image.

In the light emitting period A30 of the light emitting mode AM for displaying the red or white image, the second voltage V2 may be applied to the first electrode AND_R of the first pixel PX_R. The second voltage V2 may have a voltage level higher than that of the first voltage V1. For example, the second voltage V2 may have a voltage level of about 14 volts.

In the initialization period S10 of the sensing mode SM, the second reference voltage VR2 may be applied to the reference voltage line SL. Due to the second voltage V2 programmed in the light emitting period A30, the parasitic capacitance may be formed in the initialization period S10. For example, the second parasitic capacitance Q1 may be formed by the second voltage V2 and the second reference voltage VR2.

According to an embodiment, the second reference voltage VR2 having a voltage level between the first voltage V1 and the second voltage V2 may be applied to the reference voltage line SL in the initialization period S10 of the sensing mode SM, and thus, a difference between the first parasitic capacitance Q2 formed after displaying the black image in which the first voltage V1 is provided and the second parasitic capacitance Q1 formed after displaying the red or white image, in which the second voltage V2 is provided, may be reduced. Accordingly, when the sensing operation is performed in the sensing mode SM, influences on the sensing operation by the parasitic capacitance Cp may be reduced. Thus, a sensing accuracy may be improved, and an accuracy of the signal control circuit 100C1 in calculating the compensation value may be improved. As a result, the display quality of the electronic device ED (refer to FIG. 1) may be improved.

In contrast to the embodiment, in a case where the first reference voltage VR1 is applied to the reference voltage line SL in the initialization period S10 of the sensing mode SM, the inherent characteristics, which is sensed after the black image is displayed, and the inherent characteristics, which is sensed after the red or white image is displayed, may be different from each other with respect to the same driving transistor T1 due to the difference between the first capacitance formed by the first voltage V1 and the first reference voltage VR1 and the second capacitance formed by the second voltage V2 and the first reference voltage VR1. Accordingly, the sensing accuracy may be reduced, and the signal control circuit 100C1 may obtain incorrect compensation value when calculating the compensation value. As a result, despite the compensation for improvement of the luminance difference, the image quality may be deteriorated or degraded.

However, according to an embodiment, the second reference voltage VR2 having the voltage level between the first voltage V1 and the second voltage V2 may be applied to the reference voltage line SL in the initialization period S10 of the sensing mode SM, and thus, the difference between the first parasitic capacitance Q2 and the second parasitic capacitance Q1 may be reduced compared with the difference between the first capacitance and the second capacitance. Accordingly, when the sensing operation is performed in the sensing mode SM, influences on the sensing operation by the parasitic capacitance Cp may be reduced. Thus, a sensing accuracy may be improved, and an accuracy of the signal control circuit 100C1 in calculating the compensation value may be improved. As a result, the display quality of the electronic device ED (refer to FIG. 1) may be improved.

FIGS. 3 and 9 show the structure in which the reference voltage line SL overlaps the first pixel RX_R when viewed in plane, however, the layout of the pixel of the display panel DP (refer to FIG. 1) according to an embodiment should not be limited thereto or thereby. As an example, the reference voltage line SL may overlap the second pixel PX_G or the third pixel PX_B according to an arrangement of the first pixel PX_R, the second pixel PX_G, and the third pixel PX_B, and the above descriptions of the first pixel PX_R may be applied to the second pixel PX_G or the third pixel PX_B.

Although certain embodiments and implementations have been described herein, other embodiments and modifications will be apparent from this description. Accordingly, the inventive concepts are not limited to such embodiments, but rather to the broader scope of the appended claims and various obvious modifications and equivalent arrangements as would be apparent to a person of ordinary skill in the art.

What is claimed is:

1. An electronic device comprising:

a pixel driving circuit to operate in a light emitting mode or a sensing mode, the pixel driving circuit comprising a reference voltage line for receiving a reference voltage comprising a first reference voltage and a second reference voltage different from the first reference voltage and a first switch to connect the reference voltage line to a power supply to supply the reference voltage; and a light emitting diode comprising a first electrode, a light emitting element, and a second electrode, wherein:

the light emitting diode has an on-state or an off-state in the light emitting mode, the first reference voltage is applied to the reference voltage line in the light emitting mode, a first voltage is applied to the first electrode in the off-state of the light emitting diode, and a second voltage is applied to the first electrode in the on-state of the light emitting diode, and wherein:

the sensing mode comprises an initialization period and a sensing period, in the initialization period, the second reference voltage is applied to the reference voltage line by turning on the first switch to initialize the first electrode to the second reference voltage, and in the sensing period, the reference voltage line is disconnected from the power supply by turning off the first switch.

2. The electronic device of claim 1, wherein the second reference voltage has a voltage level between the first voltage and the second voltage.

3. The electronic device of claim 1, wherein the reference voltage has a floating state in the sensing period.

4. The electronic device of claim 1, wherein at least a portion of the first electrode overlaps the reference voltage line when viewed in plane.

5. The electronic device of claim 1, wherein the second voltage is higher than the first voltage.

6. The electronic device of claim 1, wherein the second reference voltage has a voltage level obtained by dividing a sum of the first voltage and the second voltage by 2.

7. The electronic device of claim 1, wherein the pixel driving circuit further comprises:

a driving transistor for driving the light emitting diode;

a sensing transistor electrically connected between a first node of the driving transistor and the reference voltage line; and a switching transistor electrically connected between a second node of the driving transistor and a data line.

8. The electronic device of claim 7, wherein the sensing transistor and the switching transistor are turned on in the initialization period.

9. The electronic device of claim 7, wherein:

the sensing transistor is turned on in the sensing period, and the switching transistor is turned off in the sensing period.

10. The electronic device of claim 1, wherein the first voltage has a same voltage level as the first reference voltage.

11. The electronic device of claim 1, wherein the second reference voltage is higher than the first reference voltage.

12. The electronic device of claim 1, wherein the second reference voltage is higher than the first voltage and lower than the second voltage.

* * * * *